US008176658B2

(12) United States Patent
Katz

(10) Patent No.: US 8,176,658 B2
(45) Date of Patent: May 15, 2012

(54) WOMEN'S SHOES, INCLUDING SANDALS, WITH INTERCHANGEABLE FASHION INSERTS

(76) Inventor: Marcella Miriam Katz, La Jolla, CA (US)

( * ) Notice: Subject to any disclaimer, the term of this patent is extended or adjusted under 35 U.S.C. 154(b) by 15 days.

(21) Appl. No.: 12/454,976

(22) Filed: Feb. 10, 2009

(65) Prior Publication Data

US 2010/0199521 A1 Aug. 12, 2010

(51) Int. Cl.
*A43B 3/24* (2006.01)
*A43B 23/00* (2006.01)
*A43B 3/12* (2006.01)

(52) U.S. Cl. ..... 36/100; 36/136; 36/11.5

(58) Field of Classification Search ..... 36/136, 36/132, 11.5, 9 R, 12, 3 B, 7.7, 100, 101, 36/50.1

See application file for complete search history.

(56) References Cited

U.S. PATENT DOCUMENTS 1,977,995 A * 10/1934 Morali ..... 36/11.5
2,069,381 A * 2/1937 Morgan ..... 36/54
2,291,414 A * 7/1942 Slobotkin ..... 2/254
2,583,826 A * 1/1952 Fischer ..... 36/11.5
2,801,477 A * 8/1957 Adams et al. ..... 40/636
2,887,792 A * 5/1959 Staff ..... 36/100
3,564,736 A * 2/1971 Cunningham ..... 36/1
D244,726 S 6/1977 Katz ..... D2/923
D247,932 S 5/1978 Katz ..... D2/927
D253,498 S 11/1979 Katz ..... D2/930
D254,521 S 3/1980 Katz ..... D2/917
4,516,337 A * 5/1985 Adamik ..... 36/136
4,536,975 A * 8/1985 Harrell ..... 36/136
6,023,858 A * 2/2000 Srourian ..... 36/42
7,328,528 B2 * 2/2008 Caminiti ..... 36/136
7,404,242 B1 * 7/2008 Perler ..... 24/712.2
7,412,785 B1 * 8/2008 Navasky ..... 36/100
7,481,008 B2 * 1/2009 Lusk ..... 36/100
2002/0046476 A1 * 4/2002 Snyder ..... 36/136
2010/0000126 A1 * 1/2010 Ortner ..... 36/101

* cited by examiner

*Primary Examiner* — Khoa Huynh
*Assistant Examiner* — Melissa Lalli
(74) *Attorney, Agent, or Firm* — Shirley L. Church, Esq.

(57) ABSTRACT

A shoe, including a sandal, with a transparent plastic film visible display within a permanent pouch or detachable showcase, constructed to receive, retain and display interchangeable inserts. Insert array blanks provide for Do It Yourself heat or pressure sensitive adhesive applications or can be Pre Customized fashion designs, both with quick and easy in and out insertion and replacement to match or coordinate with a variety of fashionable ensembles. The pouch or detachable showcase is mounted on the shoe in a manner which retains the insert in a substantially constant position while the wearer of the shoe is walking.

6 Claims, 2 Drawing Sheets

WOMEN'S SHOES, INCLUDING SANDALS, WITH INTERCHANGEABLE FASHION INSERTS

BACKGROUND OF THE INVENTION

1. Field of Invention

The present invention relates to fashion shoes, including sandals for women. More particularly, the invention relates to various kinds of shoes, including sandals which are provided with means to alter the decorative appearance thereof so as, if desired, to selectively change the appearance of the shoes or sandals or to match in design the fashion statement made by the other clothing of the woman wearing such shoes or sandals, in stabilized constructs.

2. Background Art

For countless years women's shoes, including sandals have been an integral part of the fashion statement made through the entire ensemble of clothing warn by women. For the most part, the matching by fashion conscious women of outer clothing components and shoes, including sandals in color and/or design has required a specific pair of shoes or sandals approximately coordinating the clothing color and/or designs. Thus, today's fashion conscious women frequently have to obtain a vast variety of shoes, including sandals being worn occasionally with a particular clothing combination. Further, because of the season-to-season and year-to-year changes in women's dress fashions, women's shoes and sandals very often become obsolete long before they have, shown use wear. Today's economy requires conservation and reuseables.

It is a principal object of the present invention to provide women's shoes and sandals having means for displaying an interchangeable series of fashion design inserts for the topmost portions and straps of such shoes and sandals for color and/or imprint design coordination thereof with the other clothing items of a woman's total clothing ensemble, precisely matched.

It is another object of the invention to provide women's shoes and sandals with means in a topmost portion and straps thereof for inserting, retaining and displaying interchangeable fashion design inserts matching in color and/or design the other clothing items of a woman's total clothing ensemble.

It is a still further object of the invention to provide women's shoes and sandals with transparent pouch means in the upper portions and straps thereof for receiving, retaining, and displaying a variety of interchangeable fashion coordinating inserts of color and/or imprint design matching in color and/or imprint design the other clothing, items of a woman's clothing ensemble, in an exact millimeter figured pouch.

It is yet another object of the invention to provide women's shoes, including sandals with pouch means which extend to the top most portion thereof for receiving, retaining and displaying interchangeable fashion inserts bearing fabrics matching in color and/or print or weave designs the color and/or print or weave designs of the fabrics of other clothing items of a woman's clothing ensemble, providing easy in-out access.

Still another object of the invention is to provide a variety of interchangeable color and/or design inserts for use in 1 ply top transparent pouches on particular portions of strips present on women's shoes and sandals with such inserts matching in fashionable array the variety of clothing items making up a woman's wardrobe and in some instances in combination with attachable-detachable male stud snap-ons around the frame, matched to female stud snap-ins to provide a shoe longitudinal strip area of display.

SUMMARY OF INVENTION

The present invention relates to women's fashion shoes, including sandals which are provided with means to quickly and effectively alter the decorative color and design appearance thereof so as, if desired, to selectively change the appearance of the shoes, including sandals or to match in coordinating manner the fashion statement made by the variety of clothing of the woman wearing such shoes or sandals. In accordance with the invention women's shoes, including sandals are provided in their visible upper topmost strap areas with pouch means for receiving, retaining and displaying interchangeable fashion design inserts. The pouch is comprised of an outer layer of transparent plastic film materials of appropriate configuration intimately affixed to a visible sandal top strap areas alone, in the form of a pouch or in combination with an attach/detach vinyl exact aligned and stud snap-on, for example and not by way of limitation.

Each pouch or showcase present on a shoe strap is provided with an opening through which interchangeable fashion design inserts may be placed within the pouch or showcase and retained by frictional proximity of the insert with the transparent film and backing of the pouch when the pouch has a configuration which provides adequate friction, in combination with the vertical natural effects of gravity on the insert.

In a typical embodiment of the invention, the pouch is in the form of a narrow, long strip of the kind shown in FIG. 1. The base of the narrow, long strip is attached to a forward portion of a shoe in the area of the toe of the shoe. The top of the narrow, long strip is attached to at least one strap which encircles the ankle of the wearer of the shoe. In some embodiments, there may be additional straps which cross the foot of the wearer of the shoe between the toe portion of the shoe and the at least one ankle strap of the shoe. The long narrow pouch strip may be attached to such additional straps which cross the foot when these are present. One of skill in the art will recognize that the number of points at which the long narrow pouch strip attaches to straps crossing the foot may vary with the design of the shoe.

The pouch strip may be sewn into the shoe and sandal structures at appropriate connections and may be appropriately framed by leather or fabric to functionally abut and guide in edges of the insert at the entry of a fashion insert and to provide subsequent firm lodging of the fashion insert within the affixed pouch.

Advantages of the invention will become apparent from the following detailed description of preferred embodiments of the invention taken in conjunction with the accompanying drawing figures.

BRIEF DESCRIPTION OF THE DRAWING FIGURES

DETAILED DESCRIPTION OF EMBODIMENTS OF THE INVENTION

Figure 1:
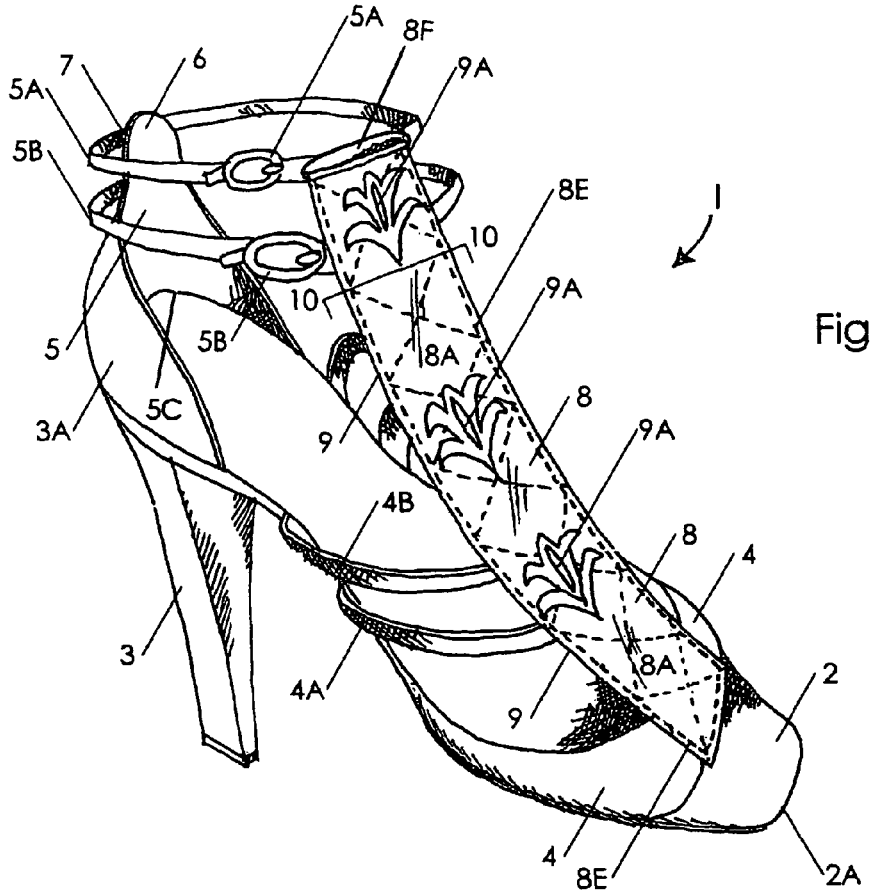
FIG. 1 is a top right front perspective view of a woman's gladiator style sandal which employs a long narrow pouch strip, in accordance with the present invention, for displaying via a designed insert in the pouch strip, where interchangeable inserts presenting a multiplicity of decorative fashion designs can be employed.
Figure 2:
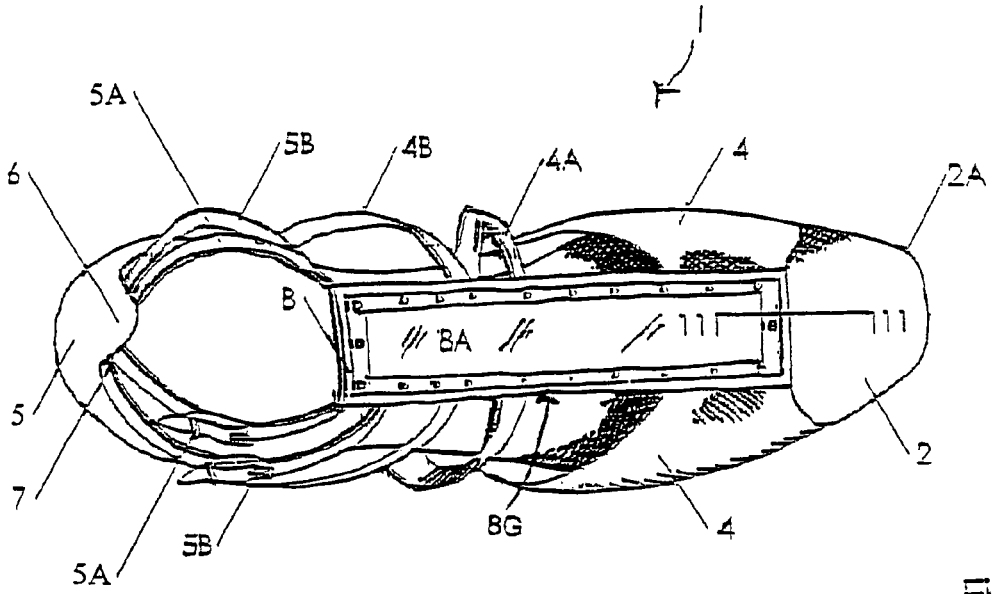
FIG. 2 is a top plan view of a woman's gladiator style sandal of the kind shown in FIG. 1, where the transparent top layer of the pouch strip may be detached.

FIGS. 1 and 2 illustrate two embodiments of the invention in the form of a woman's multi banded style shoe. FIG. 1 shows a top right perspective view of a woman's sandal 1 having a designer insert array pouch or showcase 8 for receiving interchangeable inserts 9A which enable a multiplicity of decorative fashion designs for coordinating the fashion statement made by the wearer's entire clothing and sandal ensemble. The shoe 1 is comprised of a sole member 2, including a forefoot portion 2A and a heel portion 3A, a heel member 3, a forefoot retaining band 4, instep retaining straps 4A and 4B, a rear foot retaining portion 5, buckled ankle wrap straps 5A and 5B, and, as shown, a lifted back heel portion 6 that positions the buckled ankle wrap straps 5A and 5B further stabilizing the top entry opening 8F to the insert array pouch or showcase member 8 which comprises a transparent upper surface 8A. Insert pouch or showcase member 8 interconnects at a first attachment point with at least one ankle wrap strap that goes through a back slit (not shown) in the lifted back heel portion 6. The buckled ankle wrap straps 5A and 5B encircle the top ankle of the wearer's foot and buckle on an outer side. Insert array pouch or showcase member 8 then interconnects with instep straps 4A and 4B, and is further attached and interconnected with the forefoot retaining band or strap at a second attachment point. The insert pouch or showcase member longitudinally extends from the first attachment point of the at least one ankle wrap strap to the second attachment point of the forefoot retaining band ending at each respective attachment point. The array pouch or showcase member interconnects and is suspended between the ankle wrap straps 5A and 5B and the forefoot retaining band 4 such that is it disposed directly above and longitudinally aligned along a center of the sole 2 of the shoe.

The forefoot retaining band or strap 4 of shoe 1 is proximately affixed by known means at or near its outer end portion 2 and instep end portion 2B to the outer edges of the forefoot portion 2A of sole member 2. The rear foot retaining portion 5 is proximately fixed by known means at or near its outer anchor end portion 5C. As an integral unit the insert array pouch or showcase member 8 of the shoe 1 is affixed to the at least one ankle strap 5A and/or 5B and forefoot band 4 and instep straps 4A and 4B in the embodiment as illustrated in FIG. 1. Pouch member or showcase member 8 includes an upper transparent sheet of plastic material 8A and a lower layer of shoe fabrication material 8B.

Figure 1A:
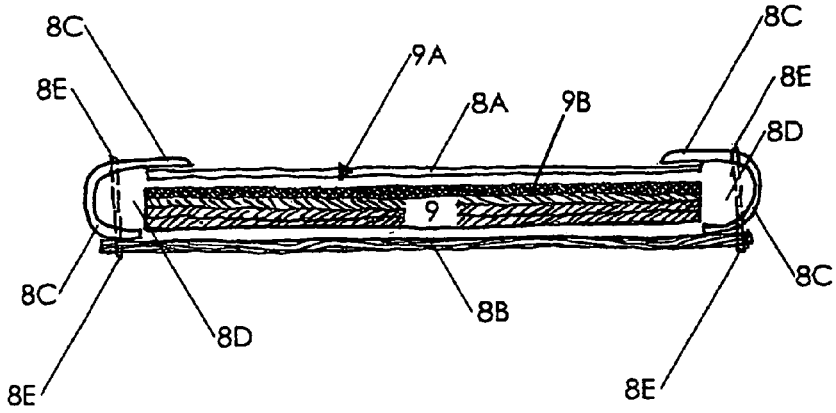
FIG. 1A is an enlarged transverse section view of a designer insert pouch of the kind which may be used in the sandal of FIGS. 1 and 2 taken on line 10-10 of FIG. 1.

As shown in FIG. 1, the designer insert 9A includes an insert backing piece or insert blank 9 as shown in FIG. 1A, to which is affixed a designer material 9B coordinated as to color and/or printed or woven design with clothing items to be work with the shoe 1.

The designer material 9B may be affixed to the backing piece 9 by adhesives, such as iron-on and pressure sensitives, depending upon the nature of what is to be made integral with the insert blank. Do it yourself customizations, if kept wafer thin, as illustrated in FIG. 1A, can include but are not limited to: paintings, sews, stitches, applique sew-ons, ribbons or salvaged vintage or sew basket scraps as all are combinable medium on the designer piece; with minimum effort and maximum displayable results.

FIG. 1A shows an enlarged transverse section view taken on line 10-10 of FIG. 1 of a designer insert and a pouch member 8. The structure of the insert array pouch member 8 is maintained by edge stitching 8E which if permanently affixed extends through the edge of area 8D to affix the peripheral edge of the upper transparent layer 8A to the peripheral edge of the lower layer of shoe fabrication material 8B and extends through the rolled edge portions of double edge frame 8C which confine upper transparent layer 8A.

The embodiment in FIG. 1A shows a picture frame effect of the insert array 9A within pouch member 8 through its inwardly projecting peripheral edge portion of double edge frame 8C which overlays the edges of the designer insert 9A seated within the pouch member 8. This double edge frame 8C which wraps over, around and under the edge portion of both sides of the upper transparent layer 8A of pouch or showcase member 8, also has a precisely measured about one millimeter less of underside framing to functionally abut and guide in edges of the insert arrays 9A, including insert blank 9, and disguise/mask any raw cut insert material edges, as the edges will be covered with a precise measure more of upper-side finished framing in this precisely layered pouch. Double edge frame 8C also separates the layers thereby providing the exact space within the pouch member for interchangeable insertion and retraction of the designer insert, as is dimensionally illustrated with respect to feature 9A.

Since the topmost pouch or showcase member is only connected to the parts that are in turn anchored to the shoe sole foot action, it is largely stress free. This topmost positioning further stabilizes the insert array area that rides above the major foot action when in motion.

As shown in FIG. 1A, the pouch opening 8F at the upper end of pouch 8 provides the pouch opening for insertion and withdrawal of the available variety of designer inserts. When well positioned gravitationally, insert arrays 9A need not be closed off from opening 8F to pouch member 8.

Figure 2A:
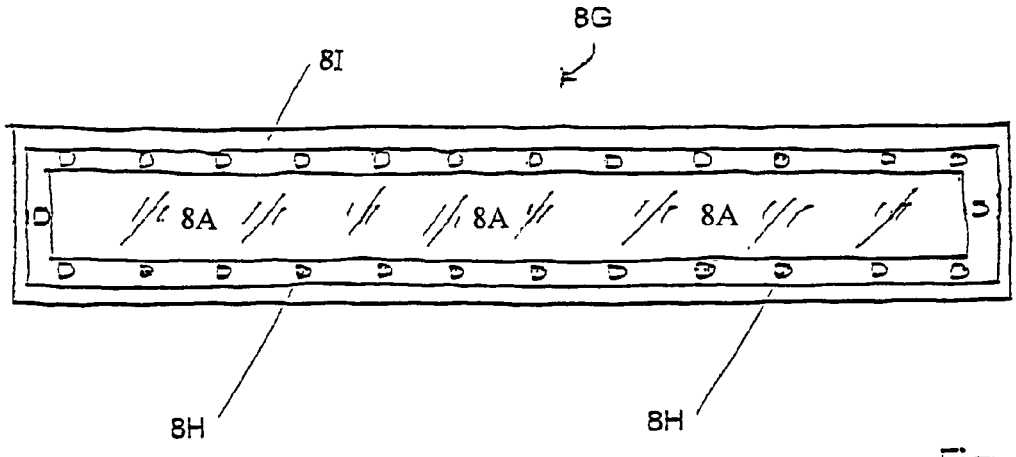
FIG. 2A is an enlarged section view of a longitudinal portion of the detachable transparent top layer of the sandal of FIG. 2 taken on line 11-11 of FIG. 2.

FIG. 2A shows an alternative vinyl centered detached male or female stud snap-on top 1-ply layer 8G of the insert array showcase 8, that replicates the functional features of FIG. 1A elements 8A-8D as shown. FIG. 2 shows the use of the alternative showcase design, where the shape of the attached top 1-ply layer 8G makes use of female or male stud snap-ons 8H which are mounted on a supporting frame 8I and which are designed to snap together with the corresponding male or female studs (not shown) which are present on an 8B lower layer of shoe fabrication material of the kind shown in FIG. 1A, for example.

This alternative embodiment has an open back whose total showcase enclosure is achievable only when attached. Mounting methods can include stud snap-ons, as well as other fixatives, so long as they hold fast and can be easily removed. Novelty outer shaped frame vinyl pouches and showcases are also feasible.

Well known variations of a shoe, including a sandal having a strip-like section traversing from the toe of the shoe to a strap which encircles the upper ankle are frequently referred to as "gladiator style" shoes. In the present invention, this style has been modified to include a strip-like pouch member or showcase member used in combination with any number of thin or thick multi-strapped forefoot and instep and rear foot and ankle strap areas or conversely fewer straps, and with or without rear heel portions. Heels can vary from flats to wedgies or platforms to stiletto height as shown.

While the present invention has been described and illustrated with reference to preferred embodiments thereof, it is obvious that modifications and alterations of such embodiments as to form, structure and materials will occur to others skilled in the art upon their reading and understanding of the description and drawings in this application. It is therefore to be understood that the present invention includes all such modifications and alterations, and equivalents thereof, being limited only by the scope of the following claims.

What I claim is:

1. A woman's shoe comprising:

an interchangeable fashion design insert, wherein said insert is present within an array pouch, wherein a strip which comprises said array pouch is attached at an upper end to a first attachment point of at least one strap adapted to encircle an upper portion of a woman's ankle, and is attached at a lower end to a second attachment point at a forefoot retaining band located at a forefoot portion of said shoe, wherein said strip longitudinally extends from said first attachment point of said at least one strap to said second attachment point of said forefoot retaining band ending at each respective attachment point, wherein said strip interconnects and is suspended between said first attachment point of said at least one strap and said second attachment point of said forefoot retaining band such that it is disposed directly above and longitudinally aligned along a center of a sole of the shoe, wherein said interchangeable fashion design insert is stabilized and maintains a given position within said array pouch due to frictional and gravitational forces when said woman walks in said shoe, wherein said array pouch comprises a top opening and includes a transparent outer layer of plastic sheet material through which said insert is visible, said transparent outer layer of plastic sheet material comprising peripheral edges, wherein a double edged frame member, which affixes the peripheral edges of said transparent outer layer of plastic sheet material to a peripheral edge of said pouch member, wraps over, around and under an edge portion of said insert, and has about a millimeter less of underside framing than topside framing with said underside framing abutting said edge portion of said insert, to functionally abut and guide edges of said insert into said pouch member.

2. A woman's shoe in accordance with claim 1, wherein said insert comprises a top layer providing a fashion design and one or more underlying layers of support structure designed to function within said array pouch.

3. A woman's shoe in accordance with claim 2, wherein said insert is sufficiently rigid such that it is easily inserted into said array pouch through said top opening.

4. A woman's shoe in accordance with claim 2 wherein said insert is flexibly stiffened so that it will not crimp due to a woman's walking in said shoe.

5. A woman's shoe in accordance with claim 1, wherein said insert comprises raw cut edges, said raw cut edges of said insert are covered so that they are not observed while said insert is in said array pouch.

6. A woman's shoe in accordance with claim 1, wherein at least one additional sparsely placed narrow strap in the form of an inset strap is present in an instep area of said shoe and is also attached to said array pouch, thereby further stabilizing said array pouch, so that a free riding insert which is inserted through said top opening of said array pouch does not shift in position within said array pouch while a woman is walking in said shoe.

* * * * *